US005199390A

United States Patent [19]

Hama et al.

[11] Patent Number: 5,199,390

[45] Date of Patent: Apr. 6, 1993

[54] CYLINDER LINER

[75] Inventors: Fujio Hama; Kenichi Harashina, both of Okaya, Japan

[73] Assignee: Teikoku Piston Ring Co., Ltd., Tokyo, Japan

[21] Appl. No.: 872,356

[22] Filed: Apr. 23, 1992

[30] Foreign Application Priority Data

May 9, 1991 [JP] Japan ..... 3-133614

[51] Int. Cl.[5] ..... F02F 1/10

[52] U.S. Cl. ..... 123/41.84

[58] Field of Search ..... 123/41.83, 41.84

[56] References Cited

U.S. PATENT DOCUMENTS 3,086,505 4/1963 Bovard ..... 123/41.84

FOREIGN PATENT DOCUMENTS 451977 10/1948 Canada ..... 123/41.84
870121 12/1941 France .
3-22554 3/1991 Japan .
1-212625 4/1991 Japan .
62-60967 6/1991 Japan .
294648 3/1929 United Kingdom .

OTHER PUBLICATIONS

Patent Abstracts of Japan, vol. 15, No. 244, JP-A-3,078,519, Apr. 3, 1991.

Patent Abstracts of Japan, vol. 15, No. 244, JP-A-3, 078,520, Apr. 3, 1991.

*Primary Examiner*—Noah P. Kamen

*Attorney, Agent, or Firm*—Armstrong, Westerman, Hattori, McLeland & Naughton

[57] ABSTRACT

A cylinder liner comprises an outer circumferential surface provided with a plurality of groups of annular grooves, a longitudinal groove communicating the annular grooves with each other and forming an outlet for a cooling liquid in each of the groups of annular grooves, and a longitudinal groove communicating the annular grooves with each other and forming an inlet for the cooling liquid in each of the groups of annular grooves. The outlet communicates in series with the inlet in the adjoining groups of annular grooves. Sectional areas of the annular grooves in the same group of annular grooves are decreased from an upstream side toward a downstream side.

8 Claims, 5 Drawing Sheets

CYLINDER LINER

BACKGROUND OF THE INVENTION

Field of the Invention

This invention relates to a cylinder liner for an internal combustion engine having cooling liquid grooves at its outer circumferential surface.

Description of the Related Art

In recent years, it has been known to provide a cooling structure for a cylinder liner flowing cooling liquid in grooves arranged at either one or both an outer circumferential surface of the cylinder liner and an inner circumferential surface of a cylinder bore in a cylinder block. This results in cooling control which can easily be carried out according to the longitudinal position in the cylinder liner as compared with the jacket type cooling structure of the past.

In order to realize appropriate cooling corresponding to the axial position of the cylinder liner, for example, the cylinder liner described in Jap. U.M. Publication No. 3-29560 (Jap. U.M. Appln. No. 62-60967) has a plurality of groups of annular grooves at its outer circumferential surface and has longitudinal grooves providing communication among the annular grooves and forming an outlet and an inlet for a cooling liquid at the surface, wherein the outlet communicates in series with the inlet in adjoining groups of annular grooves. The total sectional areas of the annual grooves in the groups of annular grooves decrease from a lower part toward an upper part of the cylinder liner.

With the foregoing, a flow of cooling liquid directed from the upper part of the cylinder liner to the lower part thereof will be described, wherein the cooling liquid flows around the outer circumference of the cylinder liner through the annular grooves in a group of annular grooves, and thereafter moves from the longitudinal groove forming the outlet of the group of annular grooves toward the longitudinal groove forming the inlet of the adjoining next stage group of annular grooves. The cooling liquid then flows from the longitudinal groove into the annular grooves of that group of annular grooves; flows around the outer circumference of the cylinder liner; and then the cooling liquid is moved to the lower adjoining group of annular grooves in the same manner.

In this case, since the total sectional areas of the annular grooves in the groups of annular grooves decrease from the lower part toward the upper part of the cylinder liner, a flow velocity of the cooling liquid in the group of annular grooves at the upper part of the cylinder liner is increased, resulting in an increase in a coefficient of heat-transfer of the cooling liquid at the upper part of the cylinder liner. Thus, a cooling capability in the upper part of the cylinder liner is increased, resulting in an appropriate cooling corresponding to a temperature gradient in the axial direction of the cylinder liner (which is higher at the upper part and lower at the lower part).

A grooved cylinder liner of the prior art having the aforesaid structure which has:

| | |
|---|---|
| Inner diameter | 84 mm |
| Outer diameter | 93 mm |
| First group of annular grooves | |
| Number of annular grooves | 3 |
| Width | 1 mm |
| Depth | 1 mm |
| Second group of annular grooves | |
| Number of annular grooves | 6 |
| Width | 2 mm |
| Depth | 1 mm |
| Third group of annular grooves | |
| Number of annular grooves | 9 |
| Width | 3 mm |
| Depth | 1 mm |

was inserted into a transparent plastic cylinder and assembled to get a cooling liquid circulation circuit, as shown in FIG. 7. In this figure, cooling oil in an oil tank 21 is fed to the first groups of annular grooves of the grooved cylinder liner 1A in the cylinder 23 by an oil pump 20 with a flow rate adjusted by a flow rate adjusting valve 22 (25 denotes a cylinder for measuring a flow rate, 26 and 27 denote stop valves). The cooling oil is then circulated and an air feeding valve 24 is opened to disperse the air bubbles into the cooling oil. A flow of the cooling oil is observed from outside, with the following results:

a) The flow of the cooling oil can generally be considered a laminar flow having a flow rate within a range of 7 liters/min per 1 cylinder or less; and b) Regarding the flow of the cooling oil in the same group of annular grooves, a flow velocity of the cooling oil flowing in the upstream side annular grooves is less than that flowing in the downstream side annular grooves.

In this case, the fact that the flow velocity in the same group of annular grooves is higher at the downstream side means that the cooling capability at the downstream side is relatively higher and the cooling capability at the upstream side is relatively lower resulting in less than optimum cooling of the cylinder liner.

Although Jap. Pat. Laid-Open No. 3-78518 (Jap. Pat. Appln. No. 1-212625) or Jap. U.M. Appln. No. 3-22554 both provide a description concerning an arrangement in which the sectional areas of the longitudinal grooves communicating the annular grooves with each other in the group of annular grooves are axially varied to produce a uniform flow speed in the group of annular grooves, these disclosed arrangements have some problems in that varying the depths of the longitudinal grooves of the cylinder liner as a means for varying sectional areas of the longitudinal grooves is undesirable because it produces a variation in wall thickness. In addition, varying the widths in a circumferential direction requires a troublesome machining operation.

SUMMARY OF THE INVENTION

It is an object of the present invention to provide a cylinder liner in which a flow speed of a cooling liquid flowing in the annular grooves in a group of annular grooves can be made uniform resulting in increased cooling efficiency.

The cylinder liner of the present invention comprises an outer circumferential surface provided with a plurality of groups of annular grooves, a longitudinal groove allowing the annular grooves to communicate with each other and forming an outlet for a cooling liquid in each of the groups of annular grooves, and another longitudinal groove allowing the annular grooves to communicate with each other and forming an inlet for a cooling liquid in each of the groups of annular grooves. The outlet communicates in series with the inlet in the adjoining groups of annular grooves, and respective sectional areas of the annular grooves within at least one said group of annular grooves are decreased from an upstream side toward a downstream side.

An outer circumferential surface located above the uppermost group of annular grooves may be provided with one annular groove which communicates with the longitudinal groove forming the inlet of the uppermost group of annular grooves.

Utilizing the foregoing apparatus, a flow of cooling liquid will be described, wherein the cooling liquid flows around the grooves in a group of annular grooves, and thereafter moves from the longitudinal groove forming the outlet of the group of annular grooves toward the longitudinal groove forming the inlet of the adjoining next stage group of annular grooves. The cooling liquid then flows from the longitudinal groove into the annular grooves of the group of annular grooves, and flows around the outer circumference of the cylinder liner, and then the cooling liquid flows to the adjoining group of annular grooves in the same manner.

In this case, when the cooling liquid flows from the longitudinal groove forming the outlet of the group of annular grooves to the longitudinal groove forming the inlet of the adjoining next stage group of annular grooves and flows from the longitudinal groove into a plurality of annular grooves of the group of annular grooves, the respective sectional areas of the annular grooves in at least one said group are decreased from the upstream side toward the downstream side, resulting in an increased pressure loss in the downstream side annular grooves such that more cooling liquid flows in the upstream side annular grooves as compared with a cylinder liner of the prior art having equal sectional areas. In addition, a flow speed of the cooling liquid flowing in the annular grooves in the same group of annular grooves can be made uniform and a cooling capability in the group of annular grooves can be made uniform. Therefore, since it is not difficult to vary the respective sectional areas of the annular grooves, the present invention results in a superior productivity.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENTS

Cooling liquid grooves are formed at an outer circumferential surface of a cylinder liner with an inner diameter of 84 mm and an outer diameter of 93 mm in an in-line four-cylinder diesel engine.

Figure 1:
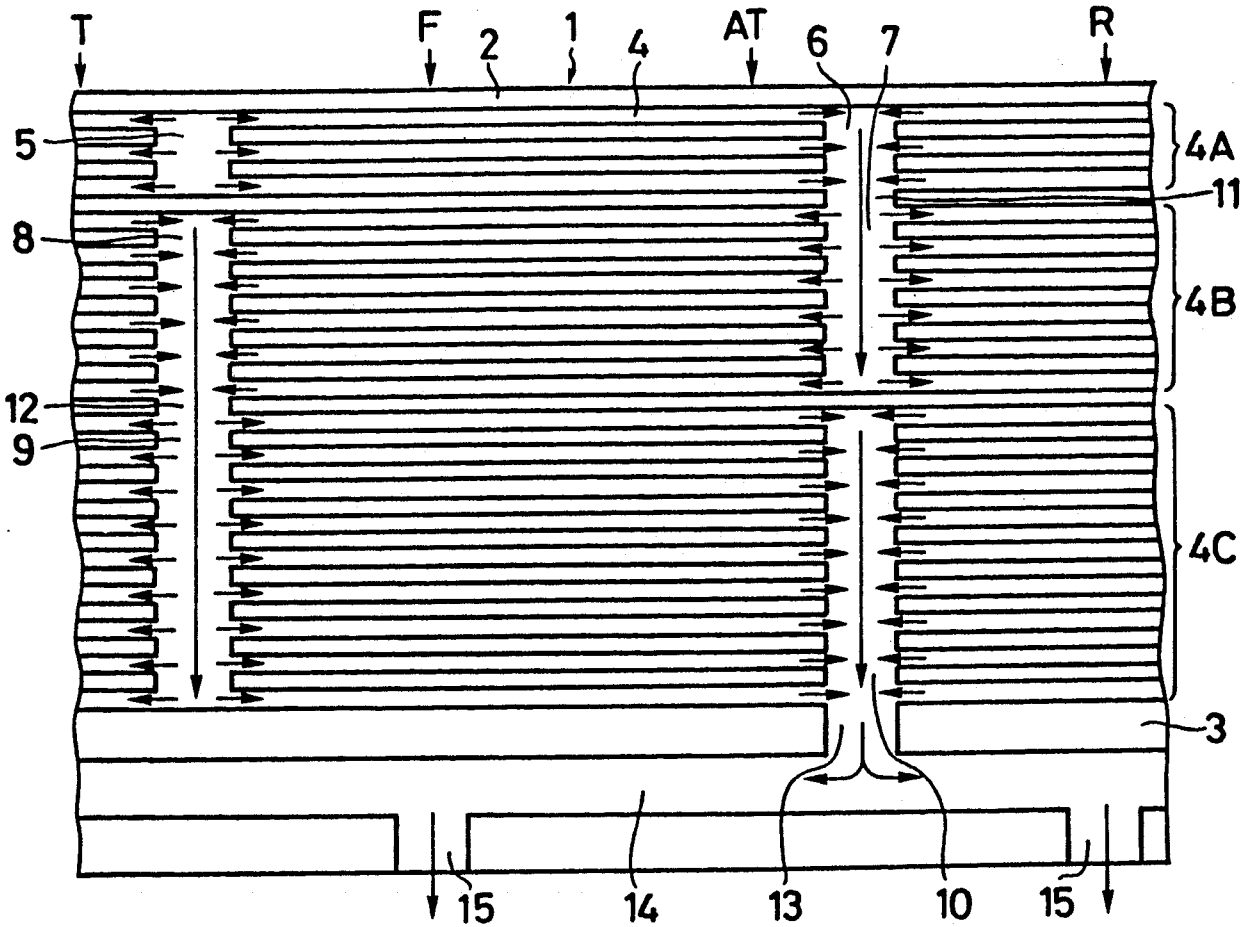
FIG. 1 is a development showing a part of the outer circumferential surface of the cylinder liner of the present invention.
Figure 2:
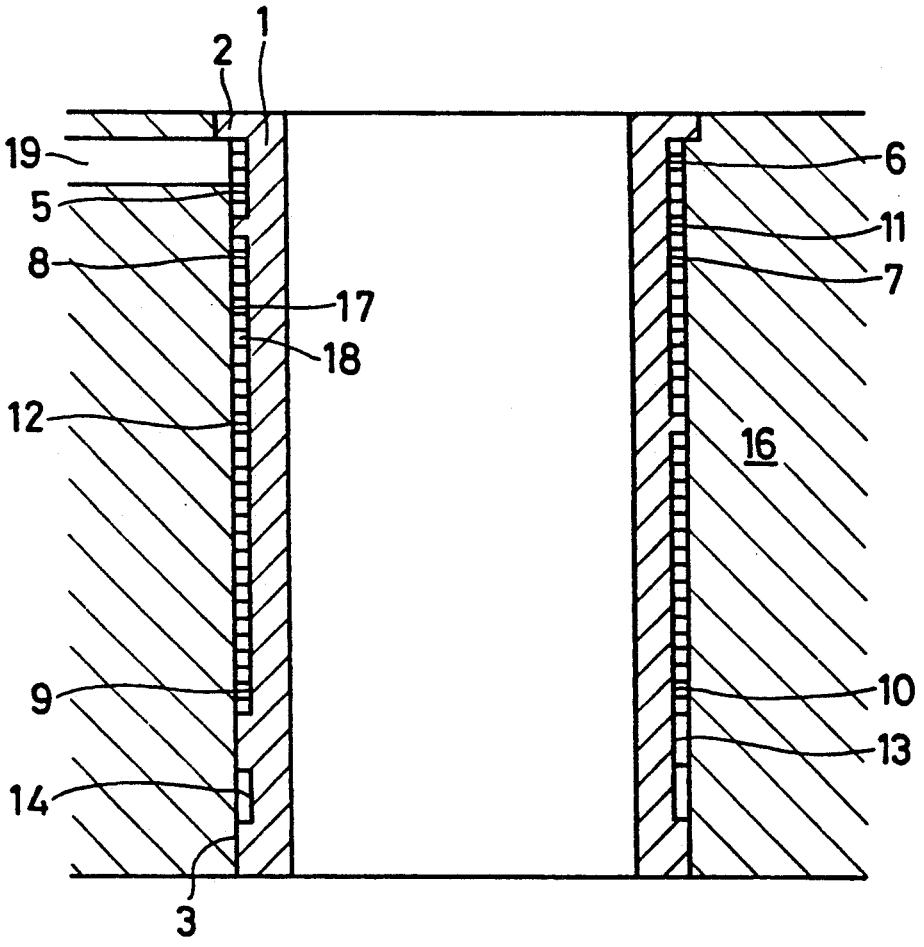
FIG. 2 is a longitudinal sectional view taken at the longitudinal grooves of the cylinder liner to show a bore part of a cylinder block into which the cylinder liner of the present invention is fitted.

That is, as shown in FIGS. 1 and 2, the cylinder liner 1 has a flange 2 at its upper end and an outer circumferential surface 3 of the cylinder liner below the flange 2 has eighteen annular grooves 4 formed in an axially spaced-apart relation. These annular grooves 4 are divided into three groups of annular grooves.

The three groups of annular grooves consist of: the first group 4A of annular grooves ranging from the first annular groove 4 at the upper end of the cylinder liner to the third annular groove 4; the second group 4B of annular grooves ranging from the fourth annular groove 4 to the ninth annular groove 4; and the third group 4C of annular grooves ranging from the tenth annular groove 4 to the last eighteenth annular groove 4.

In the first group 4A of annular grooves, two longitudinal grooves 5 and 6 providing communication between the annular grooves 4 are provided at two positions spaced apart by 180° in a circumferential direction of the cylinder liner 1, in which one longitudinal groove 5 forms a cooling liquid inlet and the other longitudinal groove 6 forms a cooling liquid outlet. Similarly, in the second group 4B of annular grooves, two longitudinal grooves 7 and 8 providing communication between the annular grooves 4 are provided at the same two positions in the circumferential direction as the longitudinal grooves 5 and 6 of the first group 4A of annular grooves. The longitudinal groove 7 located at the cooling liquid outlet side of the first group 4A of annular grooves forms a cooling liquid inlet and the other longitudinal groove 8 forms a cooling liquid outlet. Also in the third group 4C of annular grooves, two longitudinal grooves 9 and 10 providing communication between the annular grooves 4 are provided at the same two positions in the circumferential direction as the longitudinal grooves 7 and 8 of the second group 4B of annular grooves. The longitudinal groove 9 located at the cooling liquid outlet side of the second group 4B of the annular grooves forms a cooling liquid inlet and the other longitudinal groove 10 forms a cooling liquid outlet.

The longitudinal groove 6 forming the cooling liquid outlet of the first group 4A of annular grooves and the longitudinal groove 7 forming the cooling liquid inlet of the second group 4B of annular grooves communicate in series by means of a longitudinal groove 11 which is located at the same circumferential location as those of said longitudinal grooves 6 and 7 and is formed at the outer circumferential surface of the cylinder liner 1 between the third annular groove 4 and the fourth annular groove 4. In addition, similarly, the longitudinal groove 8 forming the cooling liquid outlet of the second group 4B of annular grooves and the longitudinal groove 9 forming the cooling liquid inlet of the third group 4C of annular grooves communicate in series by means of a longitudinal groove 12 which is located at the same circumferential location as those of said longitudinal grooves 8 and 9 and is formed at the outer circumferential surface of the cylinder liner 1 between the ninth annular groove 4 and the tenth annular groove 4.

Figure 3:
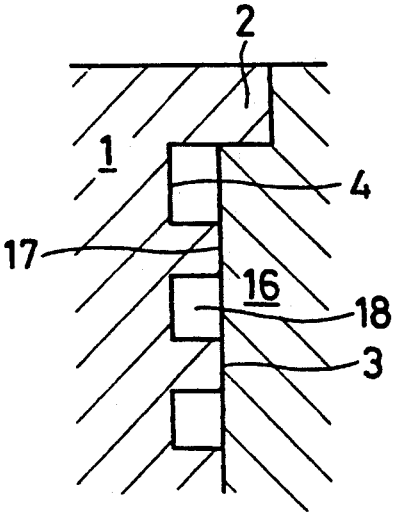
FIG. 3 is an enlarged longitudinal sectional view showing the first group of annular grooves in the cylinder liner of the present invention fitted in the cylinder block.
Figure 5:
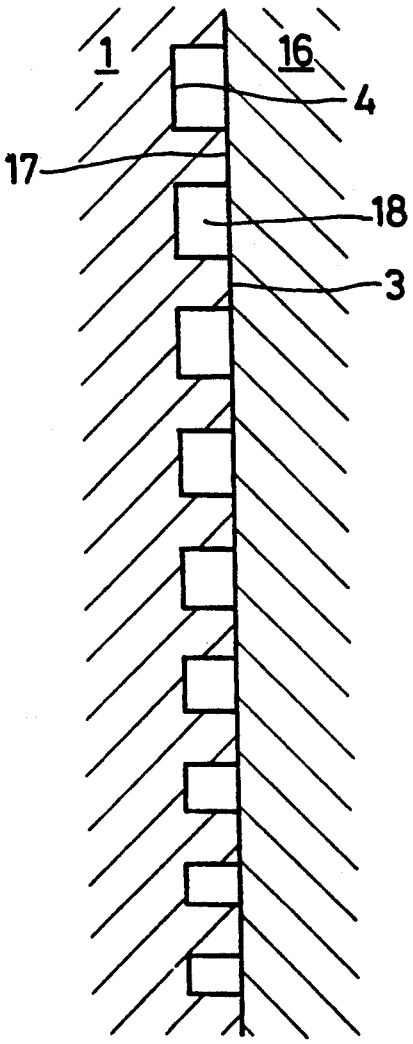
FIG. 5 is an enlarged longitudinal sectional view showing the third group of annular grooves in the cylinder liner of the present invention fitted in the cylinder block.
Figure 4:
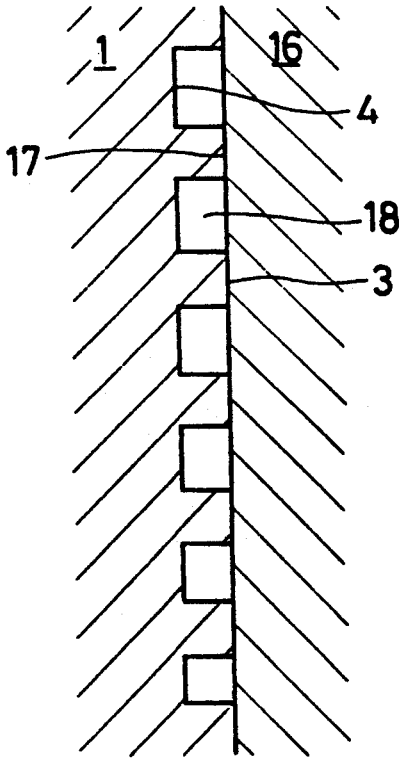
FIG. 4 is an enlarged longitudinal sectional view showing the second group of annular grooves in the cylinder liner of the present invention fitted in the cylinder block.

As shown in the enlarged view of each of the groups 4A, 4B and 4C of annular grooves in FIGS. 3 to 5, the annular grooves 4 are constructed such that the sectional areas of the annular grooves in each of the groups 4A, 4B and 4C of annular grooves are not equivalent in an axial direction and decrease from the upper side toward the lower side. As one example, a practical numerical value of the first group 4A of annular grooves is as follows: i.e., a groove width of the first annular groove 4 is 1.5 mm, a groove depth is 1 mm, a groove width of the second annular groove 4 is 1.2 mm, a groove depth is 1 mm, a groove width of the third annular groove 4 is 1.0 mm and a groove depth is 1 mm. That is, a sectional area of the first annular groove 4 is 1.5 $mm^2$, a sectional area of the second annular groove 4 is 1.2 $mm^2$ and a sectional area of the third annular groove 4 is 1.0 $mm^2$, resulting in a gradual decrease in respective cross sectional areas from the upper part toward the lower part. The cylinder liner is inserted into the aforesaid transparent plastic cylinder, air bubbles are fed while flowing cooling oil at a rate of 2 liters/min and this state is externally observed. As a result, a flow velocity of the cooling oil flowing in each of the annular grooves 4 in the first group 4A of annular grooves is substantially constant. In this way, it is possible to determine an optimum width and depth of each of the annular grooves 4 for both the second group 4B of annular grooves and the third group 4C of annular grooves.

Discharging grooves are formed in a lower part of the outer circumferential surface 3 of the cylinder liner. That is, the discharging grooves are comprised of a longitudinal groove 13 connected to the lower end of the longitudinal groove 10 forming an outlet of the third group 4C of annular grooves and disposed on an extension line of the longitudinal groove 10; an annular groove 14 connected to the lower end of the longitudinal groove 13; and two longitudinal grooves 15 having their upper ends connected to the annular groove 14, extended down to the lower end of the cylinder liner 1. The longitudinal grooves 15 are disposed at locations spaced apart by 180° in the circumferential direction.

These discharging grooves 13, 14 and 15 are formed to use cooling oil as a cooling liquid to discharge it into an oil pan. For example, when cooling water is used as a cooling liquid, the cooling water is flowed out to a discharging passage formed in the cylinder block. It is apparent that in the case of the cooling oil, the oil may be flowed out to the discharging passage in the cylinder block.

As shown in FIG. 2, cylinder liner 1 is fitted into the bore part of a cylinder block 16, and a spacing defined by an inner circumferential surface 17 of the bore part and the grooves 4 to 15 of the cylinder liner 1 forms a cooling liquid passage 18. A cooling liquid supplying passage 19 connected to the longitudinal groove 5 forming the inlet for the cooling liquid in the first group 4A of annular grooves is disposed in a lateral direction from a side surface of the cylinder block 16 and is extended linearly to the longitudinal groove 5. In FIG. 1, F denotes a forward position, R denotes a rearward position, T denotes a major thrust direction position and AT denotes a minor thrust direction position.

Accordingly, as shown in FIG. 1, the cooling oil passes through the cooling liquid supplying passage 19 in the cylinder block 16 and flows into the longitudinal groove 5 forming the inlet of the first group 4A of annular grooves in the cylinder liner. The cooling oil then flows in the annular grooves 4 in the first group 4A of annular grooves in a 180° circumferential direction toward an opposite side and flows from the longitudinal groove 6 forming the outlet of the first group 4A of annular grooves into the longitudinal groove 7 forming the inlet of the second group 4B of annular grooves.

The cooling oil flows in the annular grooves 4 in the second group 4B of annular grooves in a 180° circumferential direction toward the opposite side and flows from the longitudinal groove 8 forming the outlet of the second group 4B of annular grooves into the longitudinal groove 9 forming the inlet of the third group 4C of annular grooves.

The cooling oil flows in the annular grooves 4 in the third group 4C of annular grooves in a 180° circumferential direction toward the opposite side, flows from the longitudinal groove 10 forming the outlet of the third group 4C of annular grooves into the longitudinal groove 13 continuing to the longitudinal groove 10, flows into the annular groove 14, flows around the annular groove 14, and drops from the two longitudinal grooves 15 located at the lowest end into the oil pan not shown.

With the foregoing arrangement, the total sectional areas of the flow passages for the cooling liquid in the three groups 4A, 4B and 4C of annular grooves are respectively decreased in the upward direction, i.e., a total sectional area of the annular grooves 4 in the first group 4A of annular grooves is less than that in the second group 4B of annular grooves and a total sectional area of the annular grooves 4 in the second group 4B of annular grooves is less than that in the third group 4C of annular grooves. Accordingly, a flow velocity of the cooling oil flowing in each of the groups 4A, 4B and 4C of annular grooves is set such that a flow velocity in the central second group 4B of annular grooves is greater than that in the lower third group 4C of annular grooves and a flow velocity of the upper first group 4A of annular grooves is greater than that in the central second group 4B of annular grooves.

Accordingly, the coefficient of heat-transfer of the cooling liquid increases as the cooling liquid flows upward to the upper part of the cylinder liner 1, and as a result, the cooling capability is increased from a lower part toward an upper part and appropriate cooling corresponding to the temperature gradient in an axial direction of the cylinder liner is carried out.

In addition, since the sectional areas of the annular grooves 4 in each of the groups 4A, 4B and 4C of the annular grooves are decreased from the upper part toward the lower part, when the cooling oil flows from each of the longitudinal grooves 5, 7 and 9 into a plurality of annular grooves 4 of each of the groups 4A, 4B and 4C of annular grooves, the cooling oil flows smoothly to the upper annular grooves 4 of each of the groups 4A, 4B and 4C of annular grooves. Accordingly, the flow velocity of the cooling oil in the group of annular grooves in each of the groups 4A, 4B and 4C of annular grooves can be made uniform and the cooling capability can be made uniform.

In the aforesaid preferred embodiment, although the sectional shape of the annular groove is a rectangular one, the present invention is not limited to a rectangular groove shape but it may be a V-shape, a semi-circular one, and there is no specific limitation. However, in order to increase thermal transfer area, a rectangular shape or a square shape is preferable.

In the aforesaid preferred embodiment, a plurality of annular grooves spaced-apart in an axial direction of the cylinder liner are divided into the three groups of annular grooves and the total sectional areas of the annular grooves for the cooling liquid in the groups of annular grooves decrease from a lower part toward an upper part. However, it is also preferable that the annular grooves may be divided into two groups of annular grooves or more than three groups of annular grooves, and then the total sectional areas of the annular grooves for the cooling liquid in the groups of annular grooves may be decreased from a lower part toward an upper part.

In the aforesaid preferred embodiments, the respective sectional areas of the annular grooves in each of the groups of annular grooves decrease from the upstream side toward the downstream side. However, the sectional areas of the annular grooves for all the groups of annular grooves need not be varied. For example, the sectional areas of the annular grooves may be varied only for the upper and intermediate groups of annular grooves of the cylinder liner.

Although it is possible to vary the sectional areas of the annular grooves by varying the depth of the groove, it is preferable that the groove width is varied as indicated in the aforesaid preferred embodiment to prevent variations in the wall thickness of the cylinder liner.

Figure 6:
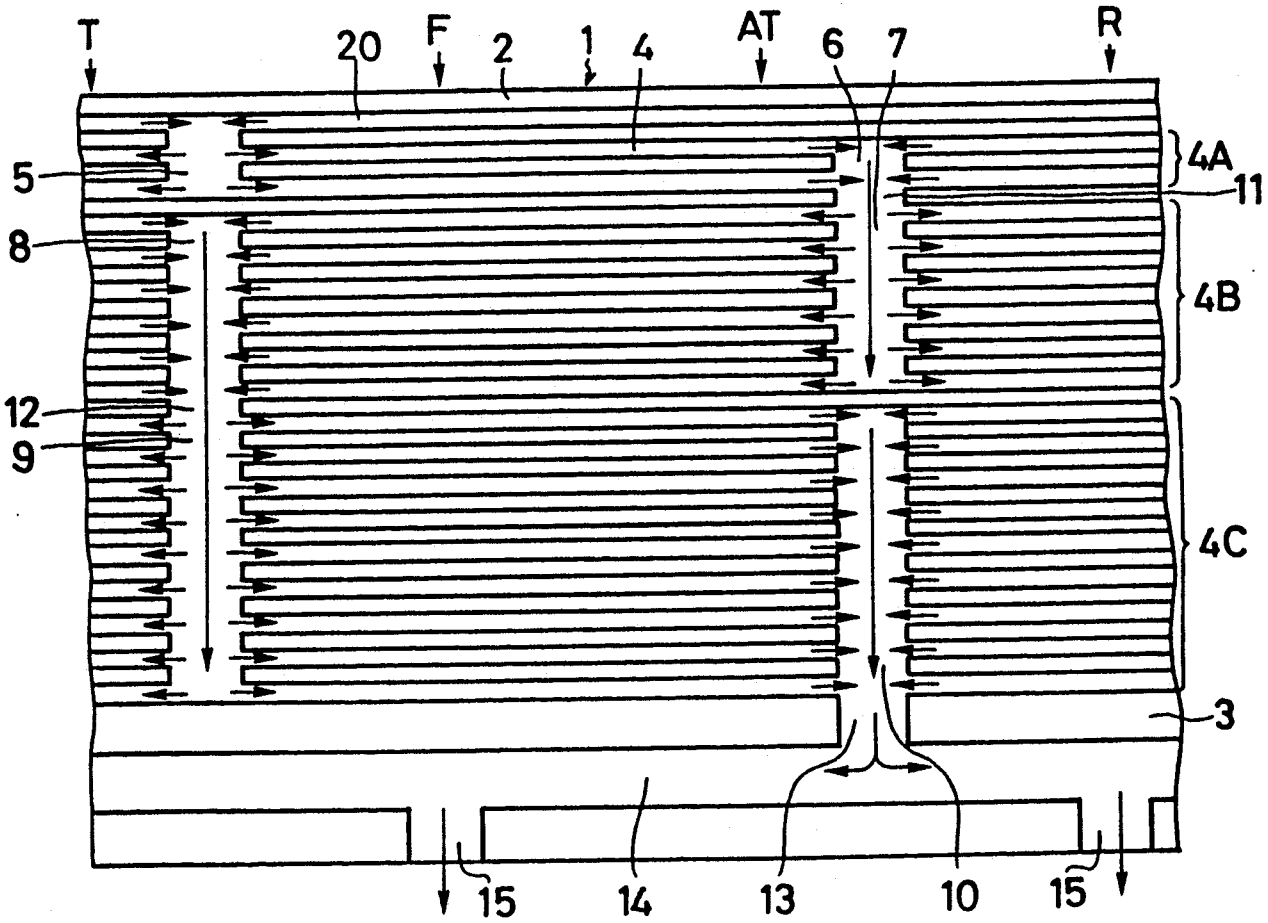
FIG. 6 is a development showing a part of an outer circumferential surface of another cylinder liner of the present invention.
Figure 7:
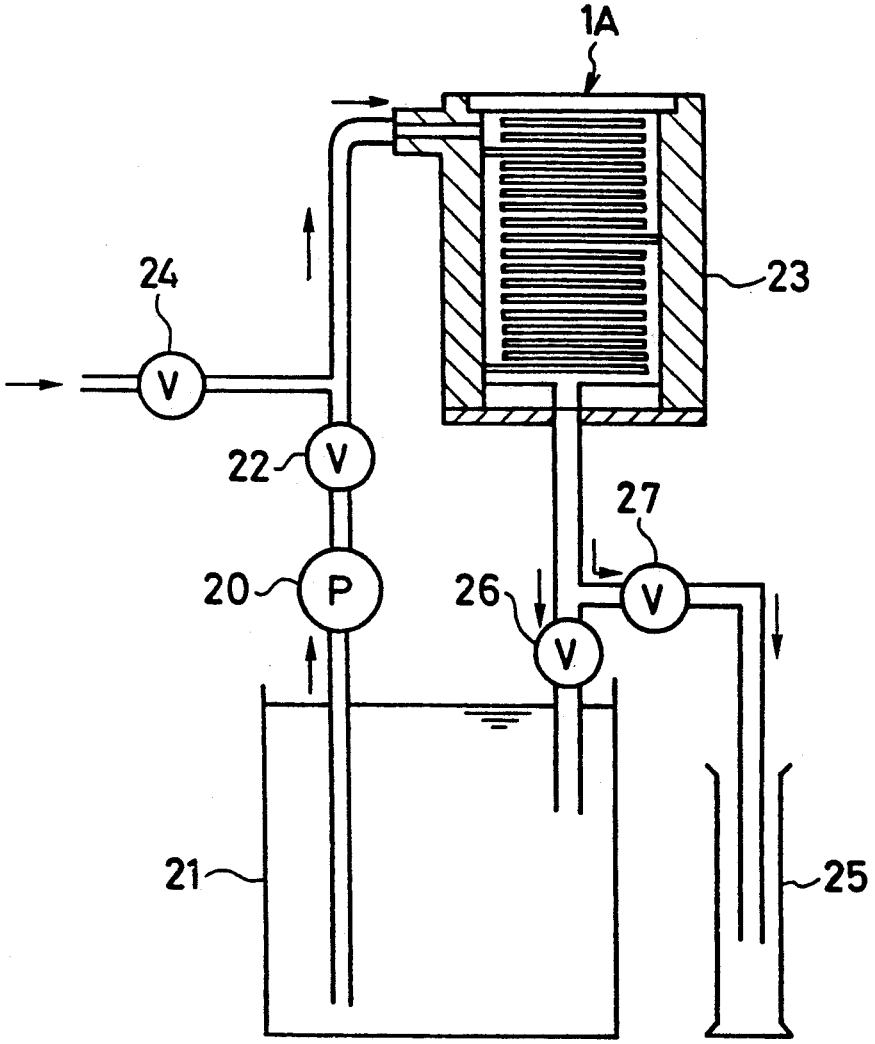
FIG. 7 is a configuration view showing a device for observing a flow of the cooling liquid in the grooves of the cylinder liner.

In addition, the present invention may also be constructed such that in addition to a plurality of groups of annular grooves, an outer circumferential surface at a position above the uppermost group of annular grooves may be provided with one annular groove communicating with the longitudinal groove forming the inlet of the uppermost group of annular grooves as shown in FIG. 6. The outer circumferential surface 3 of the cylinder liner 1 is provided with grooves having the same structure as that described in the aforesaid preferred embodiments (provided that the number of annular grooves in the first group 4A of annular grooves is two, the number of annular grooves in the second group of annular grooves is six, and the number of annular grooves in the third group of annular grooves is nine) and further the outer circumferential surface 3 at the position above the uppermost group of annular grooves, i.e., the first group 4A of annular grooves, is provided with one annular groove 20 communicating with the longitudinal groove 5 forming the inlet of the first group 4A of annular grooves.

The aforesaid cooling structure can be applied to both a diesel engine and a gasoline engine. In addition, in the cooling structure, a cylinder block made by aluminum die casting or a sectional cylinder block may be used.

Although the present invention has been described with reference to a preferred embodiment, it is apparent that the present invention is not limited to the aforesaid preferred embodiment, but various modifications can be attained without departing from its scope.

What is claimed is:

1. A cylinder liner comprising an outer circumferential surface provided with a plurality of groups of annular grooves, a longitudinal groove communicating the annular grooves with each other and forming an outlet for a cooling liquid in each of said groups of annular grooves, and a longitudinal groove communicating the annular grooves with each other and forming an inlet for the cooling liquid in each of said groups of annular grooves, wherein the outlet communicates in series with the inlet in said adjoining groups of annular grooves, and respective sectional areas of the annular grooves within at least one said group of annular grooves are decreased from an upstream side toward a downstream side.

2. A cylinder liner according to claim 1 wherein respective total sectional areas of the annular grooves in said groups of annular grooves are decreased from a lower part toward an upper part in an axial direction of the cylinder liner.

3. A cylinder liner according to claim 1 or 2 wherein an outer circumferential surface at a position above said uppermost group of annular grooves is provided with one annular groove communicating with the longitudinal groove forming the inlet of said uppermost group of annular grooves.

4. A cylinder liner according to claim 1, 2 or 3 wherein the annular grooves in the same group of annular grooves have respective sectional areas which decrease from an upstream side toward a downstream side and have the same groove depths and various groove widths.

5. A cylinder liner according to claim 1, 2 or 3 wherein the sectional areas of the annular grooves in the same group of annular grooves for all the groups of annular grooves are decreased from an upstream side toward a downstream side.

6. A cylinder liner according to claim 1, 2 or 3 wherein the respective sectional areas of the annular grooves in the same group of annular grooves for fewer than all of the groups of annular grooves are decreased from an upstream side toward a downstream side.

7. A cylinder liner according to claim 1, 2 or 3 wherein the number of said groups of annular grooves is two or more.

8. A cylinder liner according to claim 2 in which an outer circumferential surface at a position above said uppermost group of annular grooves is provided with one annular groove communicating with the longitudinal groove forming the inlet of said uppermost group of annular grooves.

* * * * *